US011840430B2

(12) United States Patent
Ijadi-Maghsoodi et al.

(10) Patent No.: US 11,840,430 B2
(45) **Date of Patent: *Dec. 12, 2023**

(54) CABLE BREAK-AWAY SAFETY DEVICE

(71) Applicant: Goodrich Corporation, Charlotte, NC (US)

(72) Inventors: Bejan Ijadi-Maghsoodi, San Dimas, CA (US); Pete J. Tucker, Chino, CA (US); Marc A. Gonfiotti, Huntingtion Beach, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 309 days.

This patent is subject to a terminal disclaimer.

(21) Appl. No.: 17/174,772

(22) Filed: Feb. 12, 2021

(65) Prior Publication Data

US 2021/0163272 A1 Jun. 3, 2021

Related U.S. Application Data

(62) Division of application No. 15/910,800, filed on Mar. 2, 2018, now Pat. No. 10,954,109.

(60) Provisional application No. 62/466,896, filed on Mar. 3, 2017.

(51) Int. Cl.
*B66D 1/34* (2006.01)
*B66D 1/58* (2006.01)

(52) U.S. Cl.
CPC ..... *B66D 1/34* (2013.01); *B66D 1/58* (2013.01)

(58) Field of Classification Search
CPC ..... B66D 1/34; B66D 1/58; F16B 31/021; B65H 75/28; Y10S 254/14; F16G 11/02
See application file for complete search history.

(56) References Cited

U.S. PATENT DOCUMENTS 1,437,987 A 12/1922 Miller
2,586,048 A * 2/1952 Hyatt ..... B66D 1/06 254/DIG. 14

(Continued)

FOREIGN PATENT DOCUMENTS

EP 2068035 A2 6/2009
GB 2424242 A * 9/2006 ..... F16G 11/00

(Continued)

OTHER PUBLICATIONS

Extended European Search Report for EP Application No. 18159711.3, dated Jul. 11, 2018, pp. 9.

(Continued)

*Primary Examiner* — Sang K Kim
*Assistant Examiner* — Nathaniel L Adams
(74) *Attorney, Agent, or Firm* — Kinney & Lange, P. A.

(57) ABSTRACT

A cable break-away device for a rescue hoist connects a cable to a cable drum of the rescue hoist. The cable break-away device provides overload protection to the rescue hoist by disconnecting the cable from the cable drum when the loads transmitted through cable become excessive. The cable break-away device is configured to fracture, releasing the cable from the cable drum, when the loads experienced by the cable break-away device exceed a predetermined failure set point. As such, the cable break-away device forms a mechanical fuse connecting the cable to the cable drum.

15 Claims, 6 Drawing Sheets

(56) References Cited

U.S. PATENT DOCUMENTS

| | | | | | |
|---|---|---|---|---|---|
| 2,855,162 | A * | 10/1958 | Schacht, Jr. | E05D 13/1261 254/DIG. 14 |
| 3,494,595 | A | 2/1970 | Bohan | |
| 3,582,011 | A | 6/1971 | Murray | |
| 3,901,610 | A | 8/1975 | Mason | |
| 4,420,755 | A | 12/1983 | Primbs, Jr. | |
| 4,787,602 | A | 11/1988 | Pidgeon | |
| 4,958,872 | A | 9/1990 | Norlen | |
| 5,125,628 | A * | 6/1992 | Rempinski | B66D 1/34 254/323 |
| 6,427,987 | B1 | 8/2002 | Campling et al. | |
| 7,108,248 | B2 | 9/2006 | Winter et al. | |
| 2003/0081986 | A1 | 5/2003 | Gordon et al. | |
| 2009/0194638 | A1 | 8/2009 | Dennis | |
| 2011/0056057 | A1 | 3/2011 | Lin | |
| 2015/0069311 | A1 * | 3/2015 | Corral Rodriguez | B66D 1/34 254/323 |

FOREIGN PATENT DOCUMENTS

| | | | |
|---|---|---|---|
| JP | H09110385 | A | 4/1997 |
| JP | 2004116286 | A | 4/2004 |

OTHER PUBLICATIONS

First Chinese Office Action for CN Application No. 201810175420.1. dated Jun. 8, 2020, pp. 13.

* cited by examiner

CABLE BREAK-AWAY SAFETY DEVICE

CROSS-REFERENCE TO RELATED APPLICATION(S)

This application is a divisional of U.S. application Ser. No. 15/910,800 filed Mar. 2, 2018 for "CABLE BREAK-AWAY SAFETY DEVICE," which in turn claims the benefit of U.S. Provisional Application No. 62/466,896, filed Mar. 3, 2017 for "CABLE BREAK-AWAY SAFETY DEVICE," by M. Ijadi-Maghsoodi, P. J. Tucker, and M. A. Gonfiotti.

BACKGROUND

The present application relates generally to hoists. More particularly, this application relates to translating body rescue hoists for aircraft.

Rescue hoists deploy and retrieve a cable from a cable drum to hoist persons or cargo. The rescue hoists may be mounted to an aircraft, such as a helicopter. The cable drum rotates to spool or unspool the cable from the cable drum, with one end of the cable attached to the cable drum and the other end, which can include a hook or other device, deployed during operation. Rescue hoists require overload protection in case the hook or cable is caught or hung up on a grounded object.

With the cable attached to the cable drum, the cable should resist pull-out from the cable drum until the cable is overloaded. When the cable is overloaded, the cable should pull out freely from the cable drum to prevent damage to the rescue hoist, the airframe, or both. The cable is typically secured to the cable drum by inserting an end of the cable into a hole in the cable drum and then securing the cable to the cable drum with set screws. The set screws are torqued to a predetermined level to prevent the cable from pulling out of the cable drum. The capacity to resist pull-out is proportional to the torque applied to the set screws and to the coefficient of friction between the set screws and the cable.

SUMMARY

According to one aspect of the disclosure, a cable break-away device includes a shear cap having a head, an attachment portion, and a neck extending between and connecting the head and the attachment portion. The neck is configured to transmit tensile forces from a cable secured to the attachment portion and to fracture with the tensile forces equal to or exceeding a predetermined fracture set point.

According to another aspect of the disclosure, a rescue hoist assembly includes a rotating cable drum supported by a frame, a shear cap attached to the rotating cable drum, and a cable secured to the shear cap. The shear cap is configured to transmit tensile forces from the cable to the cable drum and to fracture with the tensile forces equal to or exceeding a predetermined fracture set point.

According to yet another aspect of the disclosure, a method of securing a cable to a cable drum includes securing an end of a cable within a receiving chamber of a shear cap and inserting the shear cap into a mounting slot extending into a barrel of the cable drum.

DETAILED DESCRIPTION

Figure 1:
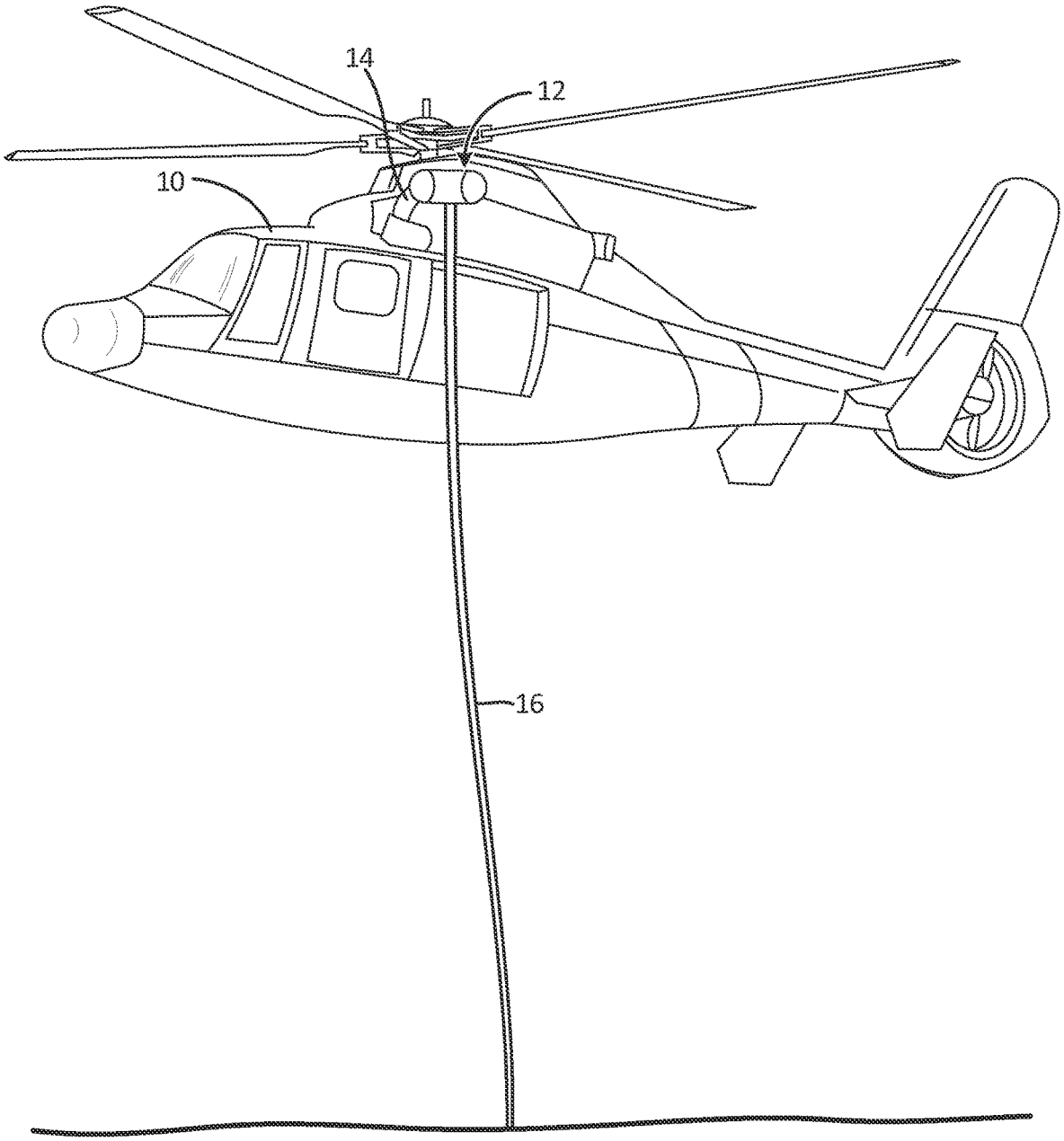
FIG. 1 is an elevation view of an aircraft and rescue hoist.

FIG. 1 is an elevation view of aircraft 10 and rescue hoist 12. Rescue hoist 12 is mounted to aircraft 10 by support 14. Cable 16 extends from rescue hoist 12 and is configured to raise and lower objects to and from aircraft 10. During operation, cable 16 can become entangled with an object on the ground, such as a tree or building, which leads to excessive loads being transmitted to rescue hoist 12 and aircraft 10 through cable 16. To prevent damage from occurring to either rescue hoist 12 or aircraft 10, cable 16 should be able to break free from rescue hoist 12.

Figure 2A:
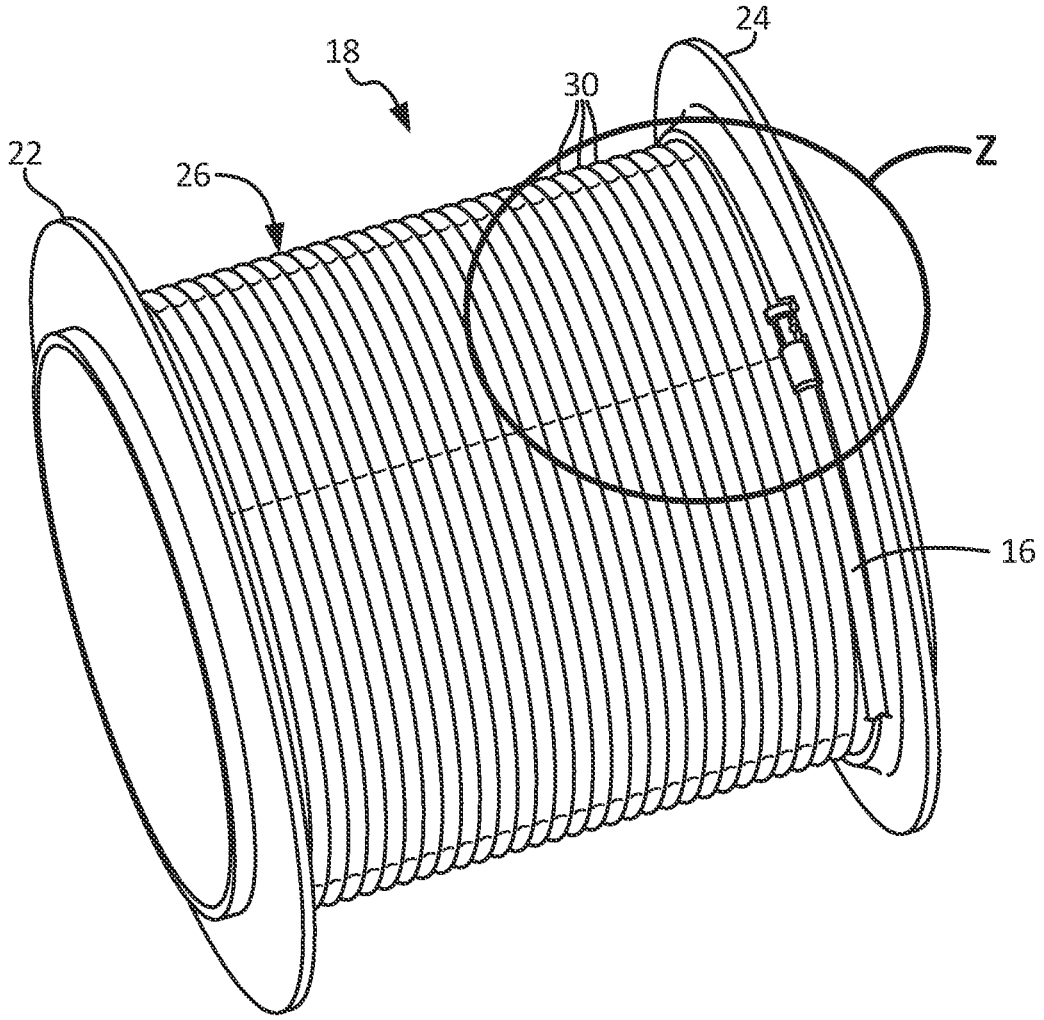
FIG. 2A is an isometric view of a cable drum and shear cap.
Figure 2B:
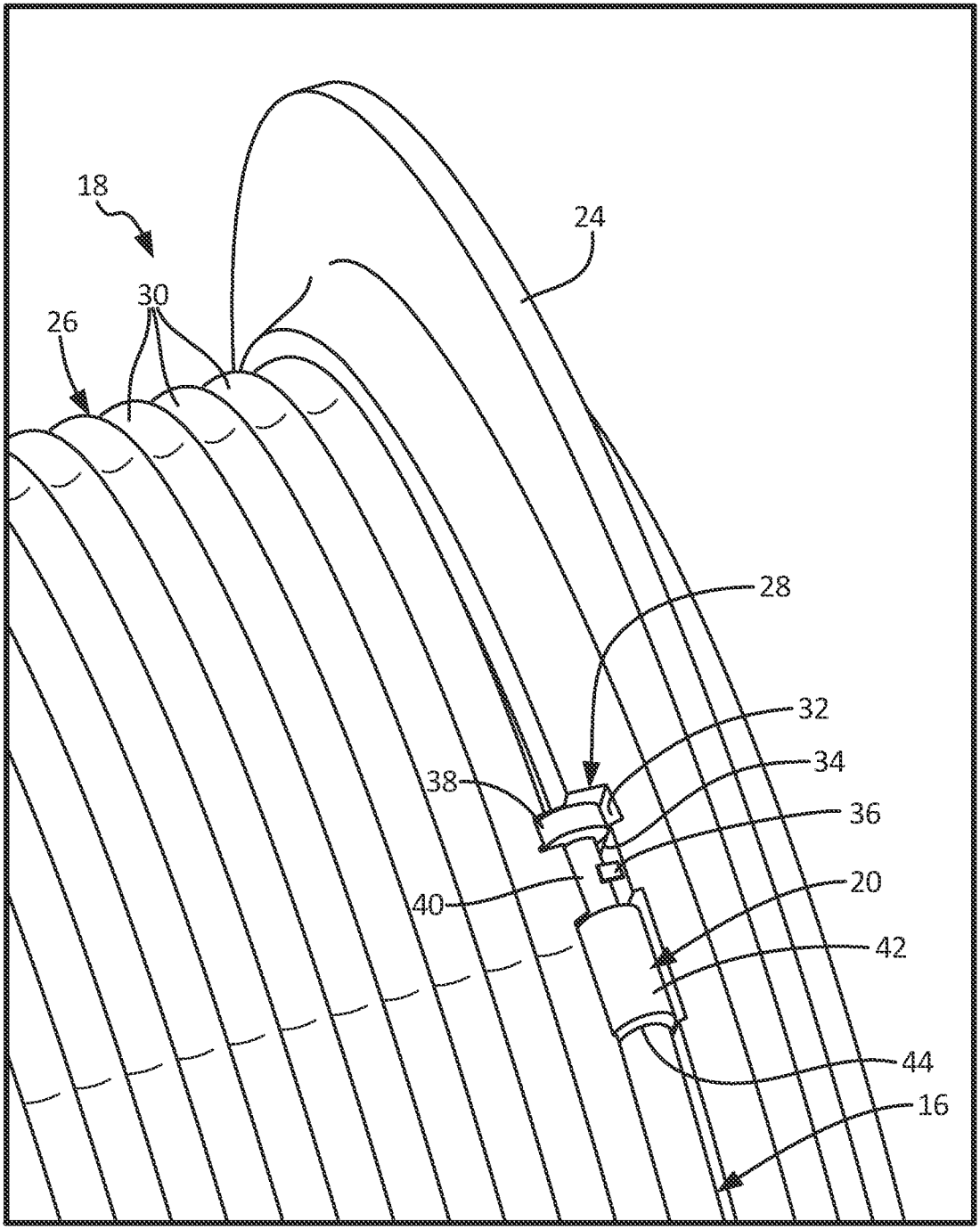
FIG. 2B is an enlarged view of detail Z of FIG. 2A.

FIG. 2A is an isometric view of cable drum 18 and shear cap 20. FIG. 2B is an enlarged view of detail Z of FIG. 2A. FIGS. 2A and 2B will be discussed together. Cable drum 18 includes first flange 22, second flange 24, and barrel 26. Barrel 26 includes mounting slot 28 and grooves 30. Mounting slot 28 includes head receiving portion 32, neck receiving portion 34, and detent 36. Shear cap 20 includes head 38, neck 40, and attachment portion 42. Cable 16 includes retained end 44.

Barrel 26 extends between and connects first flange 22 and second flange 24. Grooves 30 extend about barrel 26 and are configured to maintain a position of cable 16 on barrel 26. Mounting slot 28 extends into barrel 26. Detent 36 is spring biased to project over neck receiving portion 34 of mounting slot 28. Neck 40 extends between and connects head 38 and attachment portion 42 of shear cap 20. Retained end 44 of cable 16 extends into and is secured within attachment portion 42. Attachment portion 42 of shear cap 20 is swaged onto retained end 44 to secure retained end 44 within attachment portion 42. Cable 16 extends from attachment portion 42 and wraps around barrel 26. Cable 16 is generally disposed within grooves 30 to help ensure that cable 16 is evenly wrapped around barrel 26.

With shear cap 20 installed on cable drum 18, head 38 of shear cap 20 is disposed within head receiving portion 32 of mounting slot 28. Neck 40 extends from head 38 and is disposed within neck receiving portion 34 of mounting slot 28. Attachment portion 42 extends from neck 40 opposite head 38. A diameter of head 38 is greater than a diameter of neck 40, and as such a width of head receiving portion 32 is greater than a width of neck receiving portion 34. Neck receiving portion 34 thus helps maintain head 38 within head receiving portion 32 of mounting slot 28 because head 38 is unable to pass through the narrower width of neck receiving portion 34. Head receiving portion 32 is tightly toleranced to head 38, such that head 38 is maintained within head receiving portion 32 and prevented from torqueing out of head receiving portion 32.

Shear cap 20 is installed on cable drum 18 by pushing shear cap 20 into mounting slot 28. As shear cap 20 passes over detent 36, detent 36 depresses to allow shear cap 20 to pass into mounting slot 28 and then detent moves to a neutral position extending over neck receiving portion 34, to thereby assist in retaining shear cap 20 within mounting slot 28. For example, detent 36 can be of a ball and spring configuration, where the spring is depressed when shear cap 20 passes over detent 36, and the spring then biases the ball back over neck receiving portion 34 to retain shear cap 20 in mounting slot 28. The tight tolerance between head 38 and head receiving portion 32 ensures that shear cap 20 must lift vertically relative to mounting slot 28 to either install or uninstall shear cap 20 and cable 16.

During operation, cable 16 is deployed from cable drum 18 and utilized to hoist various objects to and from aircraft 10 (shown in FIG. 1). Shear cap 20 secures cable 16 to cable drum 18. Both aircraft 10 and rescue hoist 12 have a rated load, and experiencing loads above the rated load can cause damage to both aircraft 10 and rescue hoist 12. To prevent damage to aircraft 10 and rescue hoist 12, cable 16 should detach from cable drum 18 when the load reaches too great a level, such as where cable 16 becomes entangled with a building, tree, or other object on the ground. During operation, tensile forces are transmitted to rescue hoist 12 and aircraft 10 from cable 16 through shear cap 20. With head 38 secured in head receiving portion 32, the tensile forces are transmitted to cable drum 18 through head 38, and are transmitted to head 38 through neck 40. Neck 40 has the smallest diameter of shear cap 20 and thus is the portion of shear cap 20 with the lowest tensile strength, and neck 40 is configured to fracture when the load on cable 16 reaches or exceeds a predetermined failure point, i.e. about three times the rated load of rescue hoist 12. For example, where rescue hoist 12 has a rated load capacity of 273 kg (600 lb), then neck 40 is configured to fracture at loads exceeding 817 kg (1800 lb). When neck 40 fractures, cable 16 is detached from cable drum 18 and free to fall away from rescue hoist 12 and aircraft 10. Shear cap 20 is a breakaway safety device that prevents damage to aircraft 10 and rescue hoist 12 due to excessive loads on cable 16. It is understood that shear cap 20 can be configured to fracture at any desired load level, such that the predetermined failure set point can vary across differing applications, aircraft, and hoists.

Shear cap 20 provides significant advantages. Shear cap 20 slides into mounting slot 28 to secure cable 16 to cable drum 18, providing for simple and quick installation. Shear cap 20 further simplifies the installation process by eliminating set screws and various other small components that were previously required to secure cable 16 to cable drum 18. Shear cap 20 also provides mistake-proofing, in that shear cap 20 is configured to fracture and release cable 16 when the load on shear cap 20 reaches a predetermined failure set point. As such, shear cap 20 will not prematurely release cable 16 from cable drum 18. Mounting slot 28 is also aligned with grooves 30, which ensures that the first and each subsequent layer of cable 16 is levelly wound onto cable drum 18. Shear cap 20 further eases maintenance as cable 16 can be removed and replaced with a new cable by lifting shear cap 20 out of mounting slot 28 and sliding a new shear cap attached to a replacement cable into mounting slot 28.

Figure 3A:
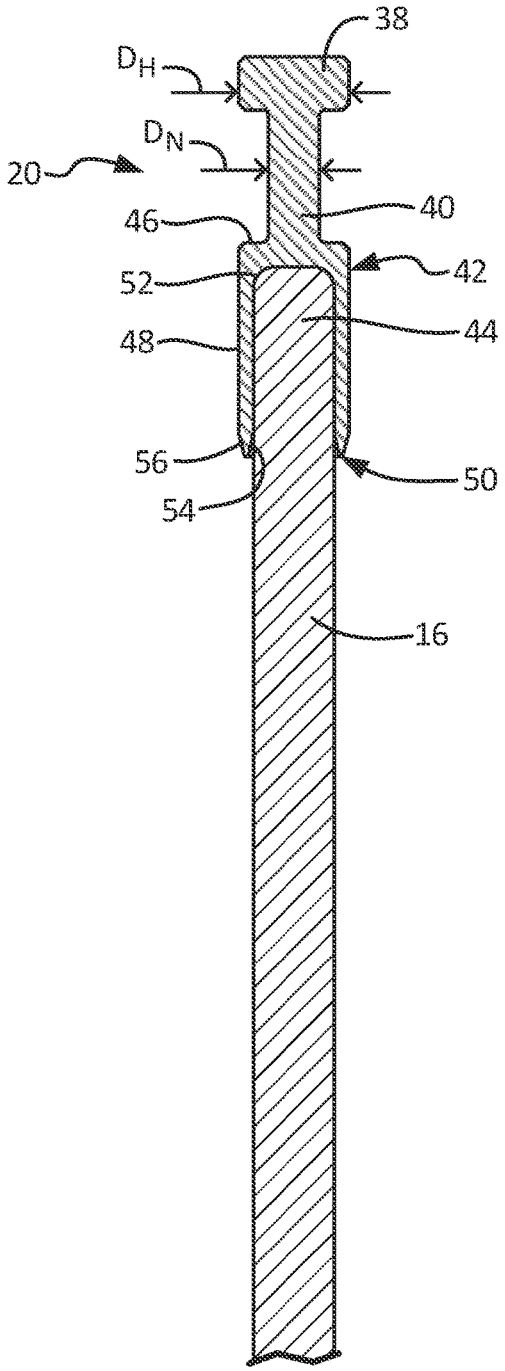
FIG. 3A is a cross-sectional view of a shear cap and cable.
Figure 3B:
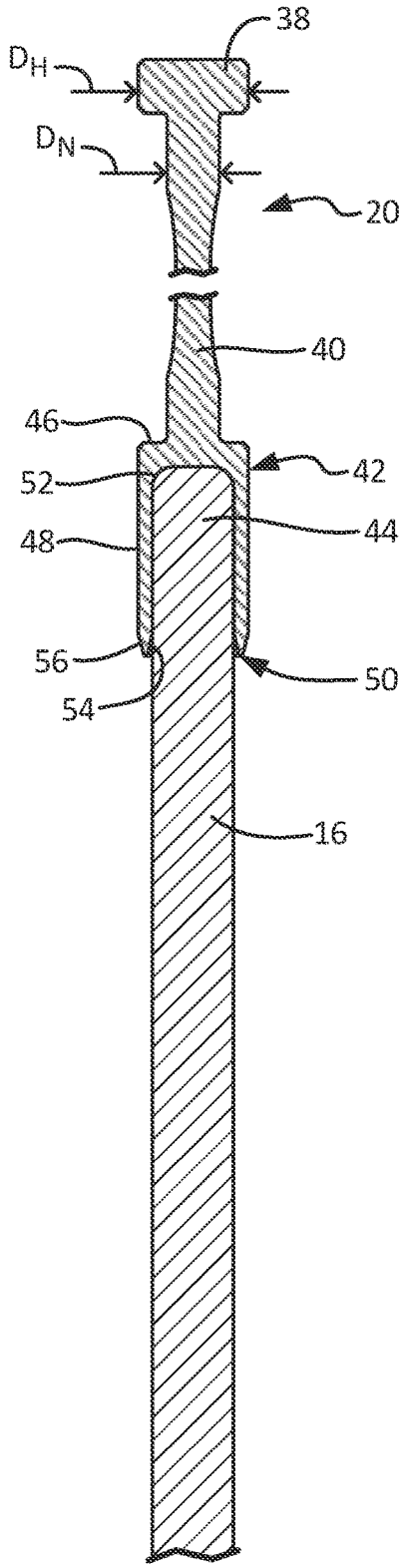
FIG. 3B is a cross-sectional view of the shear cap and cable in response to an overload event.

FIG. 3A is a cross-sectional view of shear cap 20 and cable 16. FIG. 3B is a cross-sectional view of shear cap 20 and cable 16 in response to an overload event. FIGS. 3A-3B will be discussed together. Shear cap 20 includes head 38, neck 40, and attachment portion 42. Attachment portion 42 includes base 46, side wall 48, distal end 50, and retaining chamber 52. Distal end 50 includes inner taper 54 and outer taper 56. Head 38 includes head diameter $D_H$ and neck 40 includes neck diameter $D_N$. Cable 16 includes retained end 44.

Neck 40 extends between and connects head 38 and attachment portion 42. Head 38 is disposed at an end of neck 40 opposite attachment portion 42. Base 46 of attachment portion 42 extends radially outward from neck 40. Side wall 48 extends axially from base 46 and terminates at distal end 50. Retaining chamber 52 is disposed within attachment portion 42 and is bounded by side wall 48 and base 46. Retained end 44 of cable 16 extends into retaining chamber 52 through distal end 50. Retained end 44 is preferably secured within retaining chamber 52 by swaging attachment portion 42.

In FIG. 3A, cable 16 is connected to shear cap 20. With cable 16 deployed, tensile forces on cable 16 are transmitted to cable drum 18 (shown in FIGS. 2A-2B), and thus to rescue hoist 12 (best seen in FIG. 1) through shear cap 20. Neck 40 forms a mechanical fuse between attachment portion 42 and head 38. Neck 40 is capable of transmitting tensile forces up to the predetermined set point. When the tensile forces experienced at neck 40 exceed the predetermined failure set point, neck 40 shears thereby releasing cable 16 from cable drum 18.

In FIG. 3B, shear cap 20 has experienced an overload event. When the tensile forces transmitted through neck 40 exceed the predetermined failure set point, neck 40 fractures, thereby disconnecting cable 16 from cable drum 18. The predetermined failure set point is fixed based on the dimension and material used to construct shear cap 20. In one embodiment, shear cap 20 is manufactured from stainless steel, such as 302 stainless steel, for example. It is understood, however, that shear cap 20 can comprise any desired material capable of tolerating tensile forces up to the predetermined failure set point while fracturing when the tensile forces exceed the tensile set point. For example, shear cap 20 can be a metal other than stainless steel, a ceramic material, or a composite material.

Figure 4A:
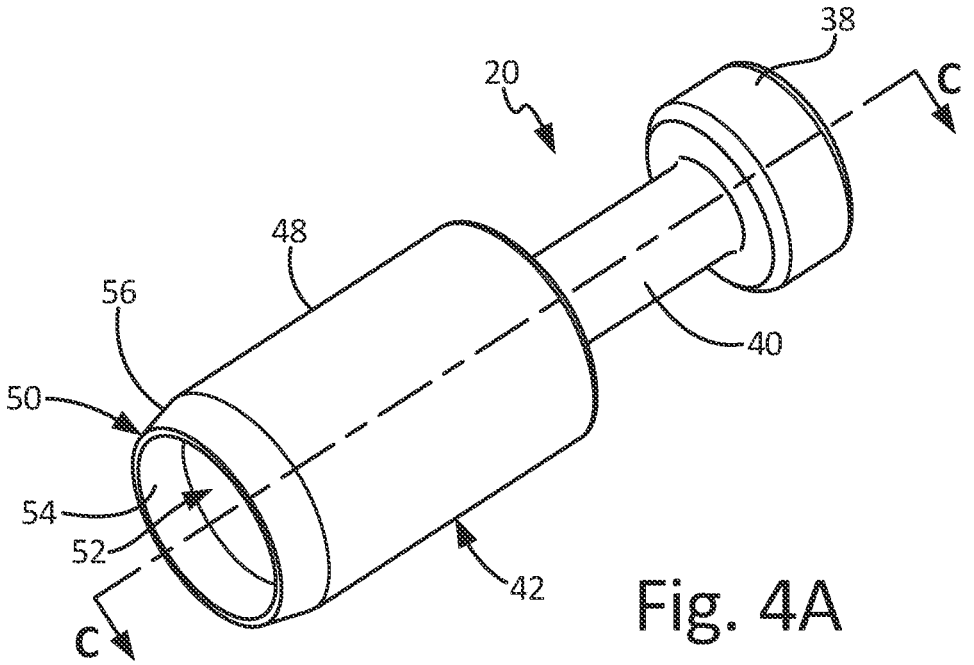
FIG. 4A is an isometric view of a shear cap.
Figure 4B:
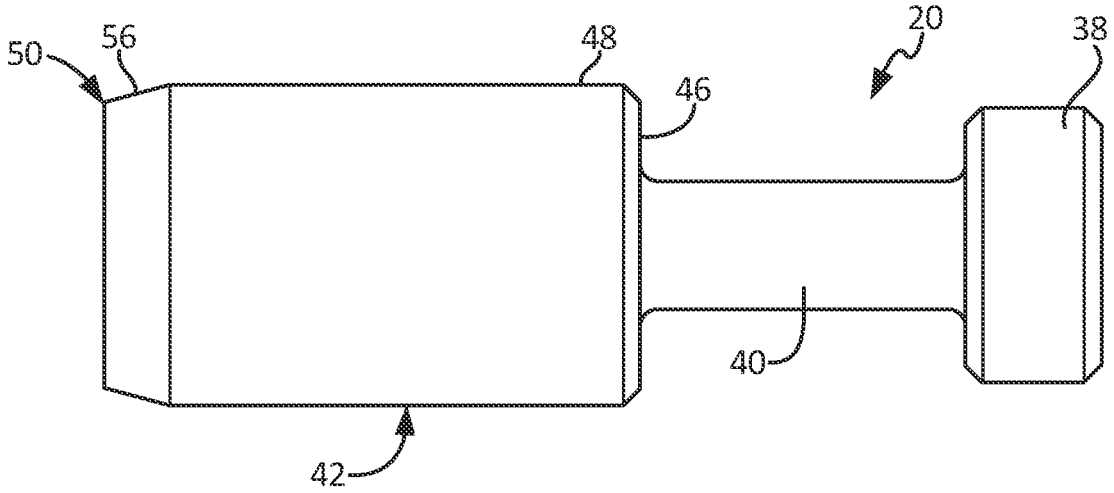
FIG. 4B is a side elevation view of the shear cap of FIG. 4A
Figure 4C:
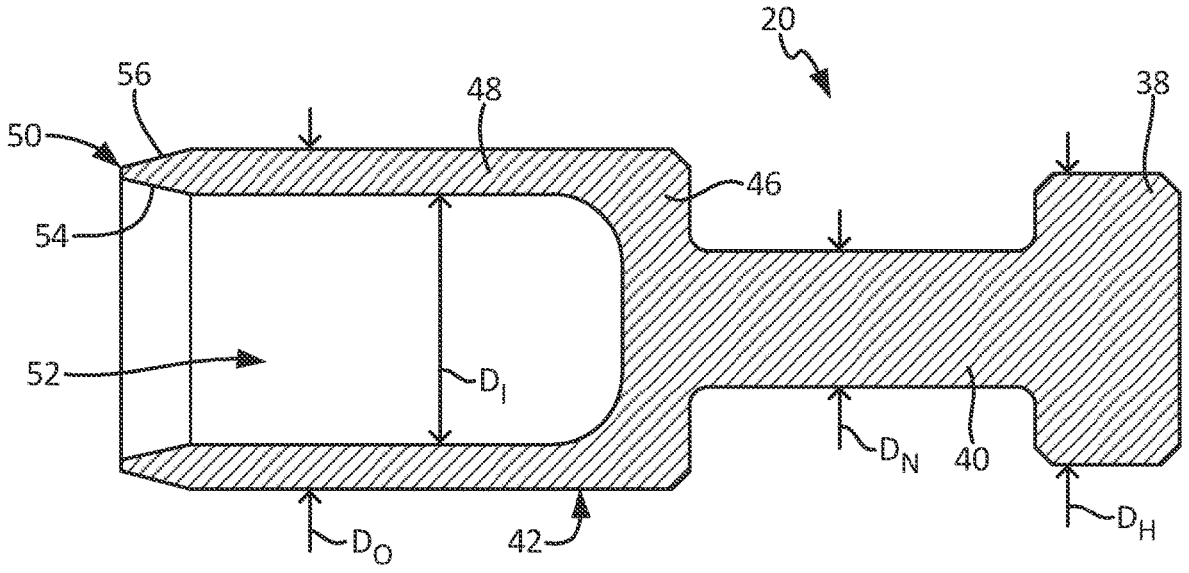
FIG. 4C is a cross-sectional view of the shear cap of FIG. 4A taken along line C-C in FIG. 4A.

FIG. 4A is an isometric view of shear cap 20. FIG. 4B is a side elevation view of shear cap 20. FIG. 4C is a cross-sectional view of shear cap 20 taken along line C-C in FIG. 4A. FIGS. 4A-4C will be discussed together. Shear cap 20 includes head 38, neck 40, and attachment portion 42. Attachment portion 42 includes base 46, side wall 48, distal end 50, and retaining chamber 52. Distal end 50 includes inner taper 54 and outer taper 56. Head 38 includes head diameter $D_H$, neck 40 includes neck diameter $D_N$, and attachment portion 42 includes inner diameter $D_I$ and outer diameter $D_O$.

Neck 40 extends between and connects head 38 and attachment portion 42. Head 38 is disposed at an end of neck 40 opposite attachment portion 42. Base 46 of attachment portion 42 extends radially outward from neck 40. Side wall 48 extends axially from base 46 and terminates at distal end 50. Retaining chamber 52 is disposed within attachment portion 42 and is bounded by side wall 48 and base 46. Head diameter $D_H$ is greater than neck diameter $D_N$.

Retaining chamber 52 is configured to receive retained end 44 (best seen in FIGS. 3A and 3B) of cable 16. With retained end 44 disposed within retaining chamber 52, attachment portion 42 is swaged onto retained end 44, thereby exerting a clamping force on retained end 44 and securing retained end 44 within retaining chamber 52. Attachment portion 42 secures cable 16 within retaining chamber 52 such that cable 16 is prevented from pulling out of attachment portion 42 during an overload event. As such, retained end 44 of cable 16 does not pull out of retaining chamber 52.

Shear cap 20 transmits tensile forces from cable 16 through neck 40. Neck 40 is configured to transmit tensile forces up to the predetermined failure set point and configured to fracture when the tensile forces exceed the predetermined failure set point. In this way, neck 40 is a mechanical fuse configured to release cable 16 from cable drum 18 (shown in FIGS. 2A-2B).

Shear cap 20 provides significant advantages. Cable 16 is directly connected to shear cap 20, eliminating loose parts previously required to secure cable 16 to cable drum 18. The predetermined failure set point is determined by the material and dimensions of neck 40, and as such shear cap 20 provides an improved factor of safety for the attachment of cable 16 to cable drum 18 because shear cap 20 ensures that cable 16 will not detach from cable drum 18 before the tensile forces on cable 16 exceed the predetermined failure set point.

Discussion of Possible Embodiments

The following are non-exclusive descriptions of possible embodiments of the present invention.

A cable break-away device includes a shear cap having a head, an attachment portion, and a neck extending between and connecting the head and the attachment portion. The neck is configured to transmit tensile forces from a cable and to fracture in response to the tensile forces reaching a predetermined fracture set point.

The cable break-away device of the preceding paragraph can optionally include, additionally and/or alternatively, any one or more of the following features, configurations and/or additional components:

The head has a first diameter, the neck has a second diameter, and the first diameter is greater than the second diameter.

The attachment portion includes a base portion extending radially from the neck, a side wall extending axially from the base portion, and a retaining chamber defined by the base portion and the side wall.

The cable is secured within the retaining chamber.

The attachment portion is swaged onto the cable.

The shear cap comprises 302 stainless steel.

A rescue hoist assembly includes a rotating cable drum supported by a frame, a shear cap attached to the rotating cable drum, and a cable secured to the shear cap. The shear cap is configured to transmit tensile forces from the cable to the cable drum and to fracture in response to the tensile forces reaching a predetermined fracture set point.

The rescue hoist of the preceding paragraph can optionally include, additionally and/or alternatively, any one or more of the following features, configurations and/or additional components:

The rotating cable drum includes a barrel extending between and connecting a first flange and a second flange, and a mounting slot extending into the barrel. The shear cap is disposed in the mounting slot.

The mounting slot extends into the barrel proximate one of the first flange and the second flange.

The mounting slot includes a head receiving portion having a first width and a neck receiving portion having a second width. The second width is smaller than the first width.

The mounting slot includes a detent extending through the barrel and over the neck receiving portion.

The shear cap includes a head and a neck, and the second width is smaller than a first diameter of the head of the shear cap.

The shear cap comprises a head having a first diameter, a neck extending from the head and having a second diameter, the second diameter being smaller than the first diameter, and an attachment portion extending from the neck opposite the head. The cable is secured to the attachment portion.

The attachment portion includes a base extending radially from the neck, a side wall extending axially from the base and away from the neck, and a retaining chamber defined between the base and the side wall, the cable is secured within the retaining chamber.

The attachment portion is swaged onto the cable.

The shear cap comprises 302 stainless steel.

A method of securing a cable to a cable drum includes securing an end of a cable within a receiving chamber of a shear cap, the shear cap including a head, a neck extending from the head, and an attachment portion extending from the neck opposite the head, the attachment portion defining the receiving chamber, and inserting the shear cap into a mounting slot extending into a barrel of the cable drum.

The method of the preceding paragraph can optionally include, additionally and/or alternatively, any one or more of the following features, configurations and/or additional components:

Inserting the end of the cable into the attachment portion of the shear cap, and swaging the attachment portion.

Inserting the head of the shear cap into a head receiving portion of the mounting slot, the head having a first diameter and the head receiving portion having a first width, inserting the neck of the shear cap into a neck receiving portion of the mounting slot, the neck having a second diameter and the neck receiving portion having a second width. The first diameter is greater than the second diameter, and the first width is greater than the second width.

The first diameter is greater than the second width.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A cable break-away device comprising:

a shear cap extending along an axis, the shear cap comprising:

a head having a first diameter;

a neck extending axially from the head and having a second diameter smaller than the first diameter, wherein the head extends annularly outward from the neck;

an attachment portion extending from the neck and away from the head, the attachment portion comprising:

a base portion extending annularly outward from the neck;

a side wall extending axially from the base portion and away from the neck; and a retaining chamber defined by the base portion and the side wall, wherein the retaining chamber is open on the axis in a direction away from the neck, the retaining chamber configured to receive a cable such that the cable is secured within the retaining chamber and the cable extends out of the retaining chamber along the axis and in the direction away from the neck, and the retaining chamber has an inner diameter that is larger than the second diameter;

wherein the neck is configured to transmit tensile forces from the cable secured within the retaining chamber of the attachment portion and the neck is configured to fracture in response to the tensile forces reaching a predetermined fracture set point.

2. The cable break-away device of claim 1, wherein the attachment portion is configured to be swaged onto the cable.

3. The cable break-away device of claim 1, wherein the shear cap is comprised of 302 stainless steel.

4. A rescue hoist assembly comprising:

a rotating cable drum supported by a frame;

a cable; and a cable break-away device comprising:

a shear cap extending along an axis, the shear cap comprising:

a head having a first diameter;

a neck extending axially from the head and having a second diameter smaller than the first diameter, wherein the head extends annularly outward from the neck;

and an attachment portion extending from the neck and away from the head, the attachment portion comprising:

a base portion extending annularly outward from the neck;

a side wall extending axially from the base portion and away from the neck; and a retaining chamber defined by the base portion and the side wall, wherein the retaining chamber is open axially away from the neck and the retaining chamber has an inner diameter that is larger than the second diameter;

wherein the cable is secured within the retaining chamber of the attachment portion;

wherein the neck is configured transmit tensile forces from the cable;

wherein the cable is secured to the cable drum by the cable break-away device; and wherein the shear cap is attached to the rotating cable drum and is configured to transmit the tensile forces from the cable to the cable drum and the neck of the shear cap is configured to fracture in response to the tensile forces reaching the predetermined fracture set point.

5. The rescue hoist of claim 4, wherein the rotating cable drum further comprises:

a barrel extending between and connecting a first flange and a second flange; and a mounting slot extending into the barrel, the shear cap disposed within the mounting slot.

6. The rescue hoist of claim 5, wherein the mounting slot extends into the barrel proximate one of the first flange and the second flange.

7. The rescue hoist of claim 5, wherein the mounting slot further comprises:

a head receiving portion having a first width; and a neck receiving portion having a second width, the second width being smaller than the first width.

8. The rescue hoist of claim 7, wherein the mounting slot further comprises a detent extending through the barrel and over the neck receiving portion.

9. The rescue hoist of claim 7, wherein the second width is smaller than the first diameter of the head of the shear cap.

10. The rescue hoist of claim 4, wherein the attachment portion is swaged onto the cable.

11. The rescue hoist of claim 4, wherein the shear cap comprises 302 stainless steel.

12. A method of securing a cable to a cable drum, the method comprising:

securing the cable to a cable break away device comprising:

a shear cap extending along an axis, the shear cap comprising:

a head having a first diameter;

a neck extending axially from the head and having a second diameter smaller than the first diameter, wherein the head extends annularly outward from the neck;

an attachment portion extending from the neck and away from the head, the attachment portion comprising:

a base portion extending annularly outward from the neck;

a side wall extending axially from the base portion and away from the neck; and a retaining chamber defined by the base portion and the side wall, wherein the retaining chamber is open axially away from the neck and the retaining chamber has an inner diameter that is larger than the second diameter;

wherein the neck is configured to transmit tensile forces from the cable secured within the retaining chamber of the attachment portion and the neck is configured to fracture in response to the tensile forces reaching a predetermined fracture set point;

inserting an end of the cable within the receiving chamber of the attachment portion of the shear cap; and inserting the shear cap into a mounting slot extending into a barrel of the cable drum.

13. The method of claim 12, wherein securing the end of the cable within the receiving chamber of the shear cap further comprises:

inserting the end of the cable into the receiving chamber of the shear cap; and swaging the attachment portion.

14. The method of claim 12, wherein inserting the shear cap into the mounting slot extending into the barrel of the cable drum further comprises:

inserting the head of the shear cap into a head receiving portion of the mounting slot, the head receiving portion having a first width; and inserting the neck of the shear cap into a neck receiving portion of the mounting slot, the neck receiving portion having a second width;

wherein the first width is greater than the second width.

15. The method of claim 14, wherein the first diameter is greater than the second width.

* * * * *